US008314826B2

(12) United States Patent
Woo

(10) Patent No.: US 8,314,826 B2
(45) Date of Patent: Nov. 20, 2012

(54) IMAGE FORMING APPARATUS AND METHOD FOR CORRECTING COLOR REGISTRATION ERROR THEREOF

(75) Inventor: Ji-Hoon Woo, Hwaseong-si (KR)

(73) Assignee: Samsung Electronic Co., Ltd, Suwon-si (KR)

( * ) Notice: Subject to any disclaimer, the term of this patent is extended or adjusted under 35 U.S.C. 154(b) by 138 days.

(21) Appl. No.: 12/560,822

(22) Filed: Sep. 16, 2009

(65) Prior Publication Data

US 2010/0080583 A1 Apr. 1, 2010

(30) Foreign Application Priority Data

Sep. 30, 2008 (KR) ..... 10-2008-0096254

(51) Int. Cl.
*B41J 2/447* (2006.01)

(52) U.S. Cl. ..... 347/236

(58) Field of Classification Search ..... 399/39, 399/40, 298, 301; 347/116, 133, 233, 236, 347/246

See application file for complete search history.

(56) References Cited

U.S. PATENT DOCUMENTS

| | | | | |
|---|---|---|---|---|
| 6,493,011 | B1 * | 12/2002 | Shioya | 347/116 |
| 7,894,101 | B2 * | 2/2011 | Ichinose et al. | 358/1.9 |
| 7,916,161 | B2 * | 3/2011 | Kusunose et al. | 347/116 |
| 2007/0188589 | A1 * | 8/2007 | Kusunose et al. | 347/238 |
| 2009/0073519 | A1 * | 3/2009 | Hiromatsu | 358/505 |

* cited by examiner

*Primary Examiner* — Huan Tran
(74) *Attorney, Agent, or Firm* — Stanzione & Kim, LLp

(57) ABSTRACT

Disclosed are an image forming apparatus capable of correcting a color registration error and a method for correcting the color registration error. The image forming apparatus can include an image receptor, a light scanning unit having a plurality of light sources and one or more beam deflectors, a developing unit, a transfer unit, and a color registration error correction unit configured to generate data about a color registration error based on a change in a light output value of the plurality of light source and to correct the color registration error between visible images formed on the image receptor.

23 Claims, 4 Drawing Sheets

IMAGE FORMING APPARATUS AND METHOD FOR CORRECTING COLOR REGISTRATION ERROR THEREOF

CROSS-REFERENCE TO RELATED APPLICATION

This application claims priority from Korean Patent Application No. 10-2008-0096254, filed on Sep. 30, 2008, in the Korean Intellectual Property Office, the disclosure of which is incorporated herein by reference in its entirety.

TECHNICAL FIELD

Apparatuses and methods consistent with the present disclosure relate generally to an image forming apparatus and a method for correcting a color registration error thereof, and more particularly, to an image forming apparatus that corrects a color registration error due to variation in the light exposure, and a method for correcting a color registration error thereof.

BACKGROUND OF RELATED ART

Generally, an electro-photographic color image forming apparatus can be classified according to the image forming method being used into one of a tandem type that forms a full-color image through a single print process and a multi-pass type that forms a full-color image by repeating multiple print processes. Among these types, the tandem-type color image forming apparatus can require multiple light scanning units scanning light beams to form each of several color images, for example, yellow (Y), magenta (M), cyan (C), and black (K) images. Each of the light scanning units can be a device that deflects and scans a beam emitted from a light source across an image receptor along a main scanning direction. A latent image can be formed on the image receptor through the scanning along the main scanning direction while rotating the image receptor in a sub-scanning direction, which is typically perpendicular to the main scanning direction.

In a tandem-type image forming apparatus, the density of color depends on the amount of developer consumed in a print process. Such density can be corrected by adjusting the light output value of a light source of the light scanning units. However, unfortunately, when the light output from the light source changes, not only can the density of the color change, but also a color registration in the main scanning direction can also change. Such a result can occur from a change in the timing of detection of the light by a detecting sensor that detects the light for the purpose of providing the horizontal synchronous signal for the light scanning operations.

The afore-described color registration error may become more pronounced in those tandem-type image forming apparatuses that employ a light scanning unit that forms at least two simultaneous scanning lines with a single beam deflector. Such tandem-type color image forming apparatuses have a first main scanning direction and a second main scanning direction opposite to the first main scanning direction. A color registration error can occur between a first main scanning direction line and a second main scanning direction line based on the change in the light output value.

SUMMARY OF THE DISCLOSURE

An aspect of the present disclosure can be achieved by providing an image forming apparatus that may include an image receptor, a light scanning unit, a developing unit, a transfer unit and a color registration error correction unit. The light scanning unit may have a plurality of light sources each configured to emit a light beam and one or more beam deflectors configured to scan a light beam emitted by the plurality of light sources to the image receptor so as to form latent images each corresponding to one of at least two colors. The developing unit may be configured to develop the latent images with developer to form visible images of the at least two colors on the image receptor. The transfer unit may be configured to transfer the visible images formed on the image receptor to a print medium. The color registration error correction unit may be configured to generate data about a color registration error based on a change in a light output of the a plurality of light sources, and to correct the color registration error between the visible images based on the data so generated.

The color registration error correction unit may comprise a color registration sensor configured to detect the light output of the a plurality of light sources, a storage unit configured to store a correction value associated with the color registration error and a controller configured to compare a first light output and a second light output of the a plurality of light sources. The first light output may be a previous light output detected by the registration sensor prior in time to a detection of the second light output. The second light output may be a current light output of the light source. The controller may be configured to determine the conversion data based on a difference between the first and second light outputs. The controller may be configured to update the correction value by using the generated conversion data.

The first light output may represent a light output from the a plurality of light sources at a time of a previous successful correction of color registration error.

The controller may be configured to generate the conversion data using a conversion function that defines a relationship between the difference between the first and second light outputs and the color registration error.

The controller may be configured to generate the conversion data by a look up operation of a conversion table that defines a relationship between the difference between the first and second light outputs and the color registration error.

By way of examples, the image receptor may include four image receptors. The at least two colors may comprise four colors. The four image receptors may be disposed sequentially and spaced apart from one another along a supply path of a print medium. Each image receptor may be associated with respective one of the four colors. The light source may include four light sources each configured to generate and emit a light beam to a respective associated one of the four image receptors. the beam deflector may comprise a first beam deflector and a second beam deflector. The first beam deflector may be configured to deflect light beams emitted by first and second ones of the four light sources toward first and second ones of the four image receptors, respectively. The second beam deflector may be configured to deflect light beams emitted by third and fourth ones of the four light sources toward third and fourth ones of the four image receptors, respectively.

According to another aspect, a method of correcting a color registration error in an image forming apparatus, which may include a light source producing light for electrostatic latent image creation, can comprise generating data about the color registration error based on a change in a light output of the light source; and correcting the color registration error based on the generated data associated with the color registration error.

The step of generating the data about the color registration error may further comprise comparing a first light output with a second light output of the light source, the first light output being a previous light output of the light source prior in time to an output of the second light output, the second light output being a current light output of the light source; generating conversion data based on a difference between the first light output and the second light output; and updating a correction value associated with the color registration error using the generated conversion data.

The generation of the conversion data may comprise calculating the conversion data using a conversion function that defines a relationship between the difference between the first and second light outputs and the color registration error.

The conversion data may comprise looking up a conversion table that defines a relationship between the difference between the first and second light outputs and the color registration error.

The method may further include determining whether the change in the light output of the light source has occurred.

According to another aspect, an image forming apparatus that has a light source for producing light that is used to form electrostatic latent images corresponding to a plurality of colors, may be provided to further comprise a storage device configured to store therein a correction value for use in correcting a color registration error; and a controller configured to correct the color registration error using the correction value, the controller being configured to determine whether a change in a light output of the light source has occurred, and, if such change is determined to have occurred, to update the correction value based on the change in the light output of the light source.

The image forming apparatus may further comprise a sensor configured to detect the light output of the light source, the controller being configured to compare a first light output and a second light output detected by the sensor, the first light output and the second light output being detected by the sensor at two different time instances.

The controller may further be configured to correct the color registration error using the correction value without updating thereof if it is determined that the change in the light output of the light source has not occurred.

The controller may further be configured to generate conversion data about the color registration error based on a difference between the first and second light outputs, and to update the correction value using the generated conversion data.

The image forming apparatus may further comprise a plurality of image receptors and a plurality of light deflectors. The light source may comprise a plurality of light sources. Each of the plurality of light deflectors may be configured to receive light beams from at least two of the plurality of light sources, and to direct the received light beams to at least two of the plurality of image receptors.

The controller may further be configured to control the light source so as to adjust a timing of light emission by the light source to thereby correct the color registration error.

BRIEF DESCRIPTION OF THE DRAWINGS

Various aspects of the present disclosure can become apparent and more readily appreciated from the following description of the embodiments, taken in conjunction with the accompanying drawings, in which.

DETAILED DESCRIPTION OF SEVERAL EMBODIMENTS

Several embodiments of the present disclosure are described with reference to accompanying drawings, wherein like numerals refer to like elements and repetitive descriptions are avoided when appropriate.

Figure 1:
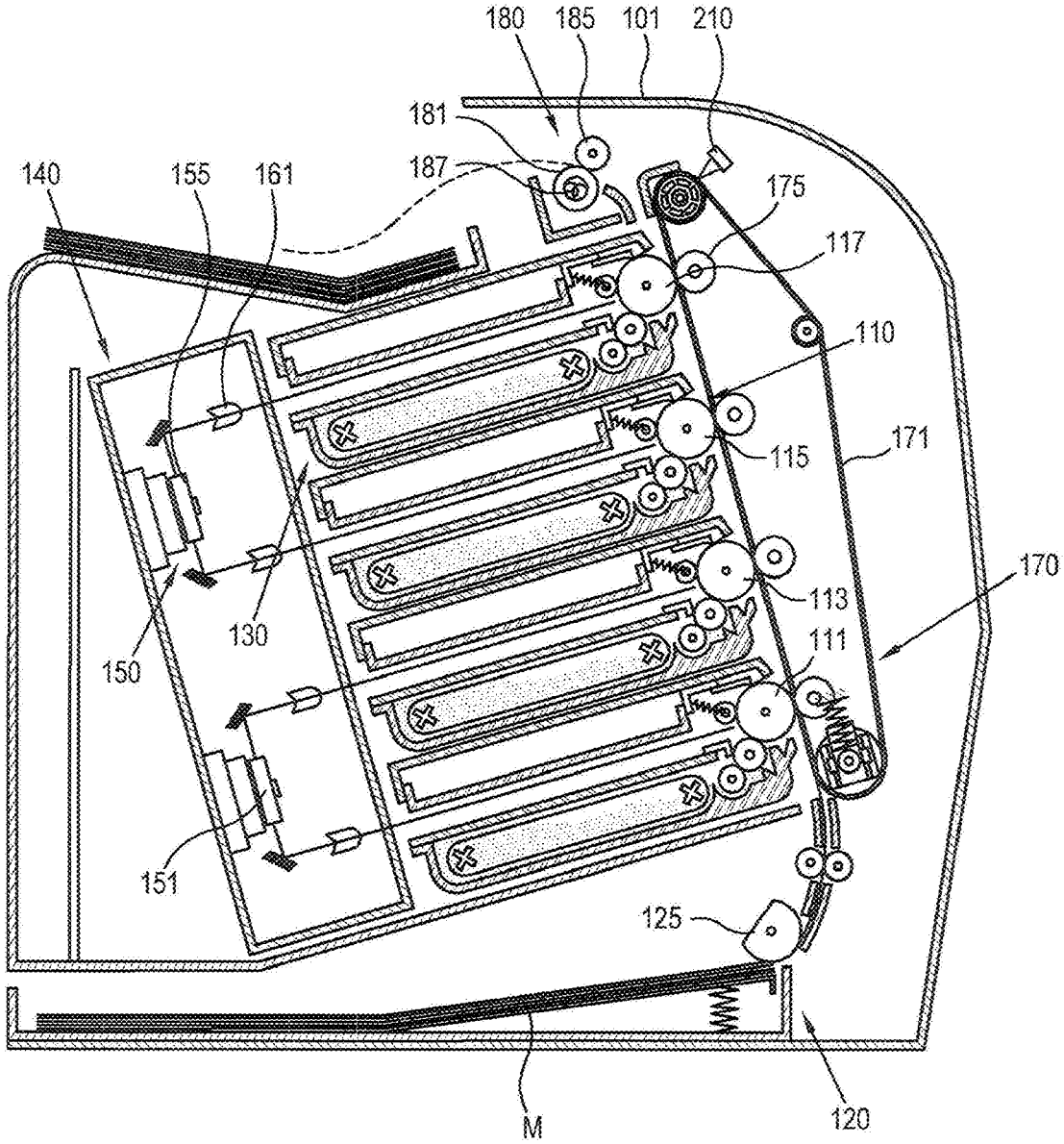
FIG. 1 is a schematic sectional view of a color image forming apparatus according to an embodiment of the present disclosure.
Figure 2:
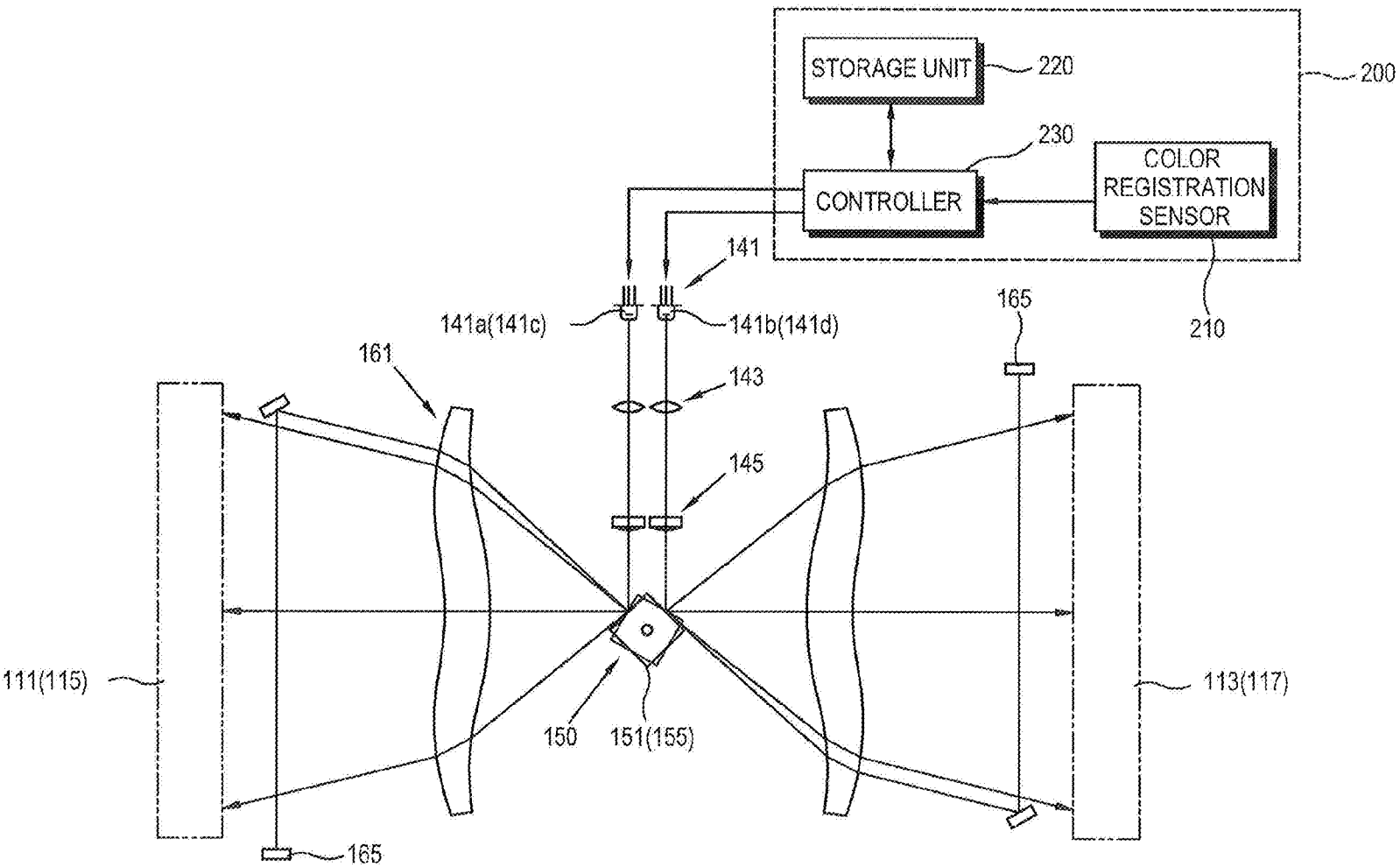
FIG. 2 is a schematic plan view illustrative of an optical arrangement of a light scanning unit shown in FIG. 1.

FIG. 1 is a schematic sectional view of a color image forming apparatus according to an embodiment of the present disclosure. FIG. 2 is a schematic plan view of the optical arrangement of the light scanning unit in FIG. 1.

Referring to FIGS. 1 and 2, the color image forming apparatus can be a tandem-type color image forming apparatus configured to form a color image through a single pass method. The color image forming apparatus can include an image receptor 110, a developing unit 130, a light scanning unit 140, a transfer unit 170 and a color registration error correction unit 200.

A cabinet 101 can be configured to define the external appearance of the image forming apparatus, and can include a supplying unit 120 configured to be detachably attached to the cabinet 101 for storing a supply of print media M. A print medium M stored in the supplying unit 120 can be picked up by a pickup roller 125 and can be transported between the developing unit 130 and the transfer unit 170 through a transporting path.

The image receptor 110 can be configured to form a latent image for each color (e.g., Y, M, C, and K images) when exposed to a light beam scanned by the light scanning unit 140. According to one embodiment, the image receptor 110 can include multiple receptors, such as a first image receptor 111, a second image receptor 113, a third image receptor 115 and a fourth image receptor 117, which can be sequentially arranged along a supplying direction of the print medium M.

The developing unit 130 can be configured to apply toner on the image receptor 110 to form a toner image on the image receptor 110. Multiple developing units 130, each associated with a particular developer color, can be provided. For example, FIG. 1 illustrates four developing units 130 that can be used to produce yellow (Y), magenta (M), cyan (C) and black (K) colors.

The light scanning unit 140 can be configured to scan a beam of light to form a latent image on each of the multiple receptors in the image receptor 110. The light scanning unit 140 can include a light source 141, a beam deflector 150 configured to deflect the beam emitted by the light source 141 along a scan line, a focusing lens 161 configured to focus the light beam deflected by the beam deflector 150 to the image receptors 110 and a synchronous signal sensor 165 configured to sense a horizontal synchronous signal of the light beam emitted by the light source 141. In one embodiment, the light source 141 can include a semiconductor device having multiple light emitting points. In another embodiment, the light source 141 can include multiple semiconductor devices each being associated with one color and having a single light emitting point.

Referring to FIG. 2, the light source 141 can be configured to generate and to emit multiple beams corresponding to an image signal based on an ON/OFF control signal and/or a light output intensity control signal produced by a controller 230. According to one embodiment, the light source 141 can include a first light source 141*a*, a second light source 141*b*, a third light source 141*c* and a fourth light source 141*d*. The light sources 141*a*, 141*b*, 141*c* and 141*d* can each be configured to generate a light beam and to emit the light beam to the image receptors 111, 113, 115 and 117, respectively.

The light source 141 can include a semiconductor device such as a laser diode, a light emitting device (LED), or other like device. The light source 141 can be used in a tandem-type image forming apparatus to form a color image in a single pass by emitting multiple beams of light concurrently. Such configuration of the light source 141 is known to those skilled in the art, and a detailed description thereof is thus not necessary for a full understanding of the present disclosure, and accordingly for the sake of brevity will not be provided.

The beam deflector 150 can be configured to deflect and to scan multiple beams emitted by the light source 141 to each of image receptors in the image receptor 110. The beam deflector 150 can include a first beam deflector 151 configured to deflect and to scan a light beam emitted to the first image receptor 111 and to the second image receptor 113 and a second beam deflector 155 configured to deflects and to scan a light beam emitted to the third image receptor 115 and to the fourth image receptor 117.

A polygon mirror device can be an example of the type of device that can be used as the first beam deflector 151 and the second beam deflector 155, which may be of substantially the same configuration with respect to each other. The polygon mirror device can be configured to deflect and to scan emitted light by rotating a polygon mirror having four or more reflecting surfaces. The first beam deflector 151 and the second beam deflector 155 need not be limited to the polygon mirror device having the foregoing configuration, and can include instead a hologram disk type beam deflector, a galvanometer mirror type beam deflector, or other like device that is configured to deflect and to scan an emitted beam.

A collimating lens 143 and a cylindrical lens 145 can be provided along an optical path defined between the light source 141 and the beam deflector 150. The collimating lens 143 can be configured to focus a beam emitted by the light source 141. The cylindrical lens 145 can have a predetermined refraction power in a sub scanning direction, and can be configured to shape an incident beam from the collimating lens 143 into a linear beam that is focused on the beam deflector 150.

The synchronous signal sensor 165 can be disposed in a non-image region, and can be configured to sense the light deflected by the beam deflector 150, the timing of such light sensing by the sensor 165, is then used to synchronize the start of scanning lines modulated with image information relating to each color in the main scanning direction. As shown in FIG. 2, when the light scanning unit 140 is arranged in a cross type, the light detection timing of the synchronous signal sensor 165 can change based on a change in a light output level of the light source 141. As a result, a color registration error can occur in the main scanning direction. The color registration error can be corrected by the color registration error correction unit 200.

In some embodiments as shown in FIG. 2, the light scanning unit 140 can be a cross type light scanning unit, for example. In other embodiments, however, the light scanning unit 140 need not be limited to a cross type light scanning unit. For example, a light scanning unit can be independently provided for each of the multiple image receptors in the image receptor 110.

The transfer unit 170 can be disposed to opposingly face the image receptor 110. The transfer unit 170 can be configured to transfer a visible image formed on the image receptor 110 to the print medium M. The transfer unit 170 can include a transfer belt 171 and multiple transfer backup rollers 175, each of which being disposed opposite one of the image receptors in the image receptor 110. The image that is transferred to the print medium M through the transfer unit 170 can be fused or fixed to the print medium M by a fusing unit 180.

The fusing unit 180 can include a heating roller 181, a pressure roller 185 and a heat source 187. The surface of the heating roller 181 can be heated by heat generated by the heat source 187. The image transferred to the print medium M can be fused to the print medium by the heat and/or pressure applied by the heating roller 181 and the pressure roller 185.

The color registration error correction unit 200 can be configured to generate data about a color registration error, for example, due to a change in a light output value of the light source 141. The color registration error correction unit 200 can further be configured to correct the color registration error based on the generated data.

The color registration error correction unit 200 can include a color registration sensor 210 configured to sense a color registration error, a storage unit 220 configured to store a correction value associated with the color registration error and a controller 230. The color registration sensor 210 may be configured to, for example, detect or measure the light output value of the light source 141 or information relating thereto, and to send or otherwise make available the detection or measurement result to the controller 230.

As would be readily understood by those skilled in the art, the controller 230 may be, e.g., a microprocessor, a microcontroller or the like, that includes a CPU to execute one or more computer instructions to implement the various control operations herein described and/or control operations relating to one or more other components of the image forming apparatus, and, to that end, may further include a memory device, e.g., a Random Access Memory (RAM), Read-Only-Memory (ROM), a flesh memory, or the like, in addition to or in lieu of the storage unit 220 shown in FIG. 2, to store the one or more computer instructions.

The controller 230 can be configured to compare a previous light output value of the light source 141 (hereinafter referred to as a first light output value) from a previous successful correction of the color registration error and the current light output value of the light source 141 (hereinafter referred to as a second light output value). The first light output value can refer to a light output value associated with a successful color registration error correction from among one or more color registration error correction processes that occurred before the current color registration error correction process. In some embodiments, the light output value associated with the first error correction process can be set as a default value for the first light output value.

The controller 230 can be configured to generate conversion data based on a difference between the first light output value of the light source 141 and the second light output value of the light source 141 when the first light output value of the source 141 and the second output value of the source 141 are different. The controller 230 can be configured to update a correction value associated with the color registration error stored in the storage unit 220 based on the conversion data so generated.

The controller 230 can use a conversion function represented by, for example, a formula or equation (see Equation 1 below) or by a conversion table (see Table 1 below) to generate the conversion data.

The conversion function can be obtained based on experimental data associated with the change in the light output value of the light source 141 and when or how a color registration error occurs as a result.

Figure 3:
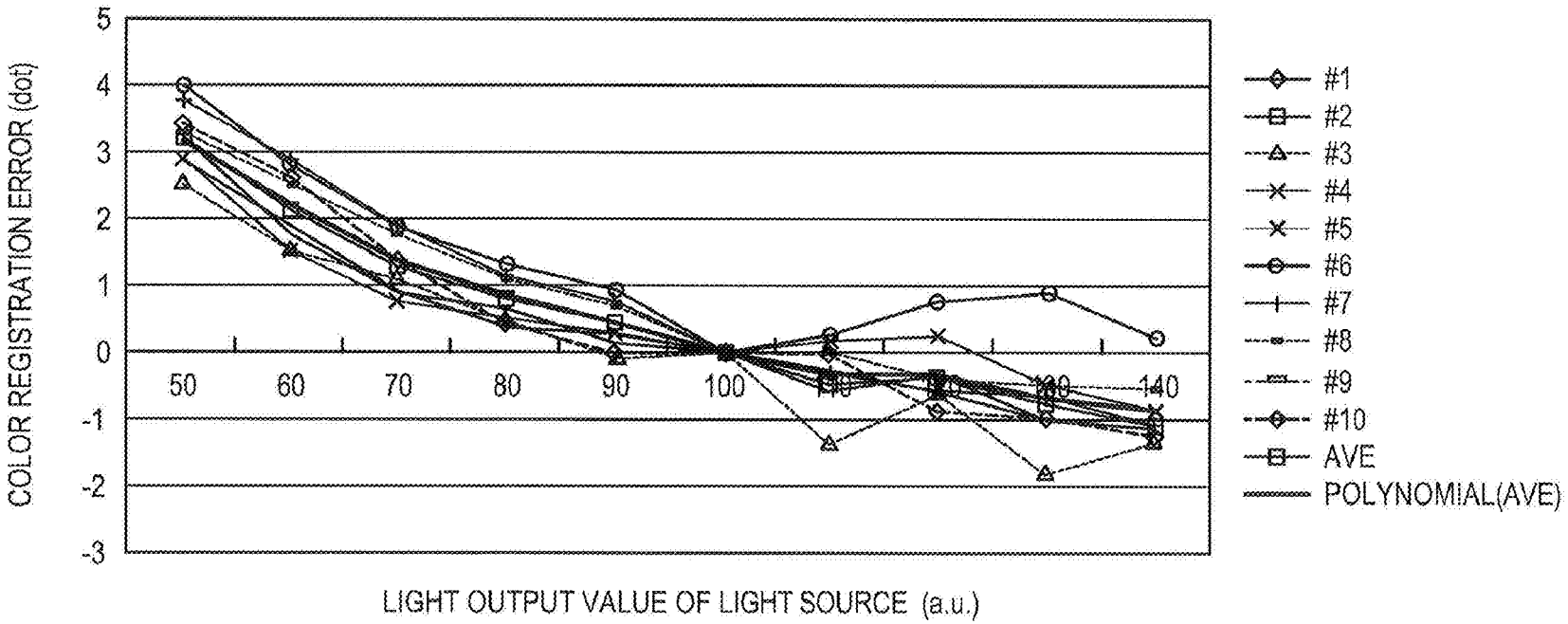
FIG. 3 is a graph which illustrates an empirically observation of a color registration error according to a change in a light output value of light sources.

FIG. 3 is a graph that shows an empirical data with respect to the color registration error in relation to the change in the light output value of the light source 141 measured for a total of 10 image forming apparatuses of the same type. In the graph shown in FIG. 3, the plots associated with #1 through #10 identify the respective behaviors of the image forming apparatuses under consideration, and from which the experimental data could be obtained. The plot labeled "AVE" represents the average value for all of the image forming apparatuses under consideration.

From the experimental results, a conversion function "y" that shows the relationship between the light output value and the color registration error can be extracted. For example, when the data in the "AVE" plot in FIG. 3 is curve-fitted by a quadratic function, the conversion function "y" can be represented by the following equation:

$$y = 0.0477x^2 - 0.9414x + 3.9131 \quad \text{(Equation 1)}$$

$$x = \frac{t}{10} - 4$$

In Equation 1, "t" refers to a light output value. "x" is the light output value normalized to 1 with respect to an arbitrary unit (a.u.) scale.

Using the conversion function, the conversion data can be generated based on the difference between the respective values of "y" corresponding to the first light output value and the second light output value of the light source 141. The correction value can be updated based on the generated conversion data.

Alternatively, the conversion data can be generated by using a conversion table that is obtained from the conversion function. Table 1 is a conversion table that shows the relationship between the color registration error and the light output value of the light source 141 as a function of the difference between the first light output value and the second light output value.

Referring to Table 1, the vertical axis (i.e., rows) represents the first light output values of the light source 141, that is, the light output values prior to a change, while the horizontal axis (i.e., columns) represents the second light output values, that is, the light output values after the change had occurred. The values in the conversion table can include values that are incremented by, for example, 10 arbitrary units within a range, e.g., from 40 a.u. to 140 a.u. for both the vertical axis and the horizontal axis.

An example of a correction value calculation using Table 1 is described below. When values for each color read from the conversion table are val_Y, val_M, val_C, and val_K, the updated X-offset value for each color in the final main scanning direction (e.g., Final X-offset(Y), Final X-offset(M), Final X-offset(C) and Final X-offset (K)) can be calculated using the following equation:

$$\text{Final } X\text{-offset}(Y) = \text{Existing } X\text{-offset}(Y) + val_Y + val_K,$$

$$\text{Final } X\text{-offset}(M) = \text{Existing } X\text{-offset}(M) + val_M + val_K,$$

$$\text{Final } X\text{-offset}(C) = \text{Existing } X\text{-offset}(C) + val_C + val_K, \text{ and}$$

$$\text{Final } X\text{-offset}(K) = \text{Existing } X\text{-offset}(K) \quad \text{(Equation 2)}$$

In the embodiment associated with Equation 2, the value associated with black (K) can be used to calculate the Final X-offset for yellow (Y), magenta (M) and cyan (C). In other embodiments, however, the calculation to determine the offset for each color in the final main scanning directions can be based on other colors.

As described above, the offset value in the final main scanning direction for each color can be calculated and the correction value associated with the color registration error stored in the storage unit 220 can be updated. In this manner, the color registration error associated with the change in the light output value of the light source can be corrected.

Figure 4:
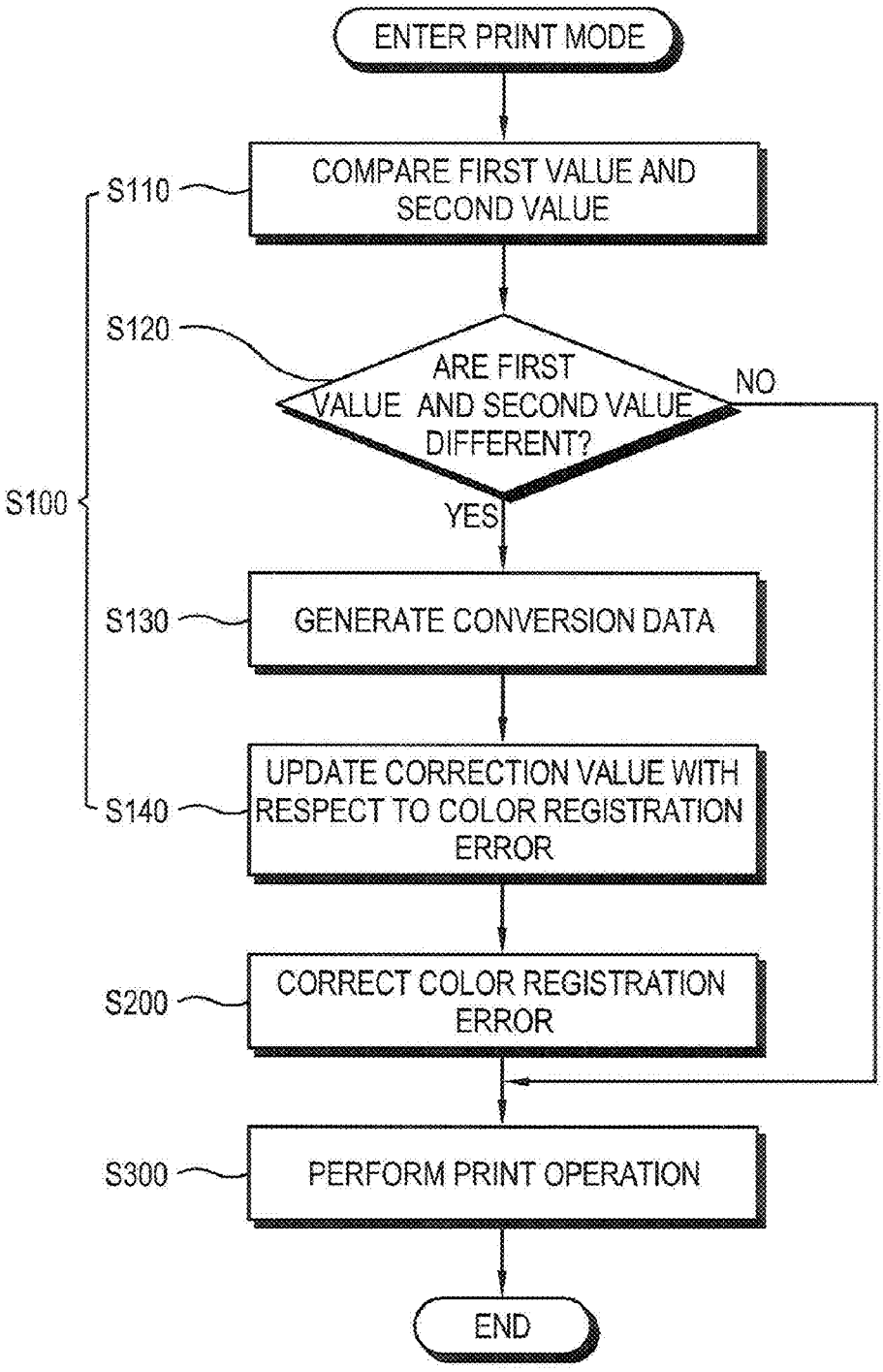
FIG. 4 is a flowchart to describe a method for correcting a color registration error of the image forming apparatus according to an embodiment of the present disclosure.

FIG. 4 is a flowchart that describes a method for correcting the color registration error of the color image forming apparatus according to an embodiment of the present disclosure.

Referring to FIGS. 1, 2 and 4, the method for correcting the color registration error can start when the color image forming apparatus enters a print mode. At S100, data can be generated about the color registration error that can occur when there is a change in the light output value of the light source 141. At S200, the color registration error can be corrected based on the data generated at S100.

The generation of data at S100 associated with the color registration error can include multiple operations. At S110, for example, the light output value of the light source 141 generated when the previous correction for the color registration error was successful (i.e., the first light output value) can be compared with the current light output value of the light source 141 (i.e., the second light output value). At S120, whether there is a difference between the first light output value and the second light output value of the light source 141 can be determined. When there is no difference between the first light output value and the second light output value, the

TABLE 1

| | | Light output value (after change) [a.u.] | | | | | | | | | | |
|---|---|---|---|---|---|---|---|---|---|---|---|---|
| Y/M/C/K | | 40 | 50 | 60 | 70 | 80 | 90 | 100 | 110 | 120 | 130 | 140 |
| Light output value (before change) | 40 | 0 | 1 | 2 | 3 | 3 | 4 | 4 | 4 | 4 | 5 | 5 |
| | 50 | −1 | 0 | 1 | 2 | 2 | 3 | 3 | 3 | 3 | 4 | 4 |
| | 60 | −2 | −1 | 0 | 1 | 1 | 2 | 2 | 2 | 2 | 3 | 3 |
| | 70 | −3 | −2 | −1 | 0 | 0 | 1 | 1 | 1 | 1 | 2 | 2 |
| | 80 | −3 | −2 | −1 | 0 | 0 | 1 | 1 | 1 | 1 | 2 | 2 |
| | 90 | −4 | −3 | −2 | −1 | −1 | 0 | 0 | 0 | 0 | 1 | 1 |
| | 100 | −4 | −3 | −2 | −1 | −1 | 0 | 0 | 0 | 0 | 1 | 1 |
| | 110 | −4 | −3 | −2 | −1 | −1 | 0 | 0 | 0 | 0 | 1 | 1 |
| | 120 | −4 | −3 | −2 | −1 | −1 | 0 | 0 | 0 | 0 | 1 | 1 |
| | 130 | −5 | −4 | −3 | −2 | −2 | −1 | −1 | −1 | −1 | 0 | 0 |
| | 140 | −5 | −4 | −3 | −2 | −2 | −1 | −1 | −1 | −1 | 0 | 0 |

process can proceed to S300 in which the print operation is performed. On the other hand, when there is a difference between the first light output value and the second light output value of the light source 141, the conversion data can be generated at S130 based on that difference. At S140, the correction value associated with the color registration error can be updated by using the conversion data generated at S130. The conversion data can be generated by a conversion function (e.g., Equation 1) or a conversion table (e.g., Table 1) that shows the relationship between the color registration error and the light output value of the light source 141 according to the difference between the first light output value and second light output value. This is approach is substantially the same as the approach previously described above, and thus a detailed description of the same need not be repeated.

After the color registration error is corrected at S200 based on the updated correction value, the print operation can be performed at S300.

With the foregoing configuration, the color image forming apparatus and method for correcting the color registration error thereof according to aspects of the present disclosure can generate data about the color registration error according to the change in the light output value of the light source, and can correct the color registration error with the generated data. That is, the color image forming apparatus and method for correcting the color registration error thereof according to aspects of the present disclosure can correct the color registration error by updating the correction value according to a changed light output value of the light source for correction of color density even when the light output value of the light source is changed.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a plurality of image receptors;

a light scanning unit having a plurality of light sources each configured to emit a light beam and one or more beam deflectors configured to deflect a light beam emitted by the plurality of light sources onto scan lines of the image receptors so as to form latent images each corresponding to one of at least two colors;

a plurality of developing units configured to develop the latent images with developer to form visible images of the at least two colors on the image receptors;

a transfer unit configured to transfer the visible images formed on the image receptors to a print medium; and a color registration error correction unit configured to generate data about a color registration error, based on a change in a light output of the plurality of light sources, and to correct the color registration error based on the generated data.

2. The image forming apparatus according to claim 1, wherein the color registration error correction unit comprises:

a color registration sensor configured to detect the light output of the plurality of light sources;

a storage unit configured to store a correction value associated with the color registration error; and a controller configured to compare a first light output and a second light output of the plurality of light sources, the first light output being a previous light output detected by the color registration sensor prior in time to a detection of the second light output, the second light output being a current light output of a respective one of the light sources, the controller being further configured to determine conversion data based on a difference between the first and second light outputs, and to update the correction value by using the determined conversion data.

3. The image forming apparatus according to claim 2, wherein the first light output represents a light output from the plurality of light sources at a time of a previous successful correction of color registration error.

4. The image forming apparatus according to claim 2, wherein the controller is configured to generate the conversion data using a conversion function that defines a relationship between the difference between the first and second light outputs and the color registration error.

5. The image forming apparatus according to claim 2, wherein the controller is configured to generate the conversion data by a look up operation of a conversion table that defines a relationship between the difference between the first and second light outputs and the color registration error.

6. The image forming apparatus according to claim 1, wherein the at least two colors comprise four colors and the plurality of image receptors include four image receptors, disposed sequentially and spaced apart from one another along a supply path of a print medium, each image receptor being associated with respective one of the four colors, wherein the plurality of light sources include four light sources each configured to generate a light beam and to emit the generated light beam to a respective associated one of the four image receptors, and wherein the one or more beam deflectors comprise:

a first beam deflector configured to deflect light beams emitted by first and second ones of the four light sources toward first and second ones of the four image receptors, respectively; and a second beam deflector configured to deflect light beams emitted by third and fourth ones of the four light sources toward third and fourth ones of the four image receptors, respectively.

7. A method of correcting a color registration error in an image forming apparatus that includes a light source producing light for electrostatic latent image creation, comprising:

generating data about the color registration error based on a change in a light output of the light source; and correcting the color registration error based on the generated data associated with the color registration error.

8. The method according to claim 7, wherein the generating the data about the color registration error comprises:

comparing a first light output with a second light output of the light source, the first light output being a previous light output of the light source prior in time to an output of the second light output, the second light output being a current light output of the light source;

generating conversion data based on a difference between the first light output and the second light output; and updating a correction value associated with the color registration error using the generated conversion data.

9. The method according to claim 8, wherein the generation of the conversion data comprises calculating the conversion data using a conversion function that defines a relationship between the difference between the first and second light outputs and the color registration error.

10. The method according to claim 8, wherein the generation of the conversion data comprises looking up a conversion table that defines a relationship between the difference between the first and second light outputs and the color registration error.

11. The method according to claim 7, further comprising:

determining whether the change in the light output of the light source has occurred.

12. An image forming apparatus having a light source for producing light that is used to form electrostatic latent images corresponding to a plurality of colors, comprising:

a storage device configured to store therein a correction value for use in correcting a color registration error; and a controller configured to correct the color registration error using the correction value, determine whether a change in a light output of the light source has occurred, and, if a change is determined to have occurred, to update the correction value based on the change in the light output of the light source.

13. The image forming apparatus according to claim 12, further comprising:

a sensor configured to detect the light output of the light source, the controller being further configured to compare a first light output and a second light output detected by the sensor, the first light output and the second light output being detected by the sensor at two different time instances.

14. The image forming apparatus according to claim 12, wherein the controller is further configured to correct the color registration error using the correction value without updating thereof if it is determined that a change in the light output of the light source has not occurred.

15. The image forming apparatus according to claim 13, wherein the controller is further configured to generate conversion data about the color registration error based on a difference between the first and second light outputs, and to update the correction value using the generated conversion data.

16. The image forming apparatus according to claim 12, further comprising:

a plurality of image receptors; and a plurality of beam deflectors, wherein the light source comprises a plurality of light sources, each of the plurality of beam deflectors being configured to receive light beams from at least two of the plurality of light sources, and to direct the received light beams to at least two of the plurality of image receptors.

17. The image forming apparatus according to claim 12, wherein the controller is further configured to control the light source so as to adjust a timing of light emission by the light source to thereby correct the color registration error.

18. A color registration error correction apparatus, comprising:

a plurality of light sources to output light;

a plurality of synchronous signal sensors to detect the light output from each of the plurality of light sources; and a controller to generate data about a color registration error according to a detected change in a light output of the plurality of light sources, and to correct the color registration error of an image according to the generated data.

19. The color registration error correction apparatus according to claim 18, wherein the controller compares a first light output and a second light output of the plurality of light sources, the first light output being a previous light output detected by the plurality of synchronous signal sensors prior in time to a detection of the second light output, the second light output being a current light output of a respective one of the light sources, the controller to determine the conversion data according to a difference between the first and second light outputs, and to update the correction value by using the determined conversion data.

20. A method of correcting color registration errors in an image forming apparatus, the method comprising:

outputting light from a plurality of light sources;

detecting the light output from the plurality of light sources with a color plurality of synchronous signal sensors; and generating data about a color registration error according to a detected change in a light output of the plurality of light sources, and correcting the color registration error of an image according to the generated data with a controller.

21. The image forming apparatus according to claim 1, wherein, when an intensity of light output by a respective one of the light sources is changed from a first light output value to a second light output value, the color registration error correction unit generates the data which is used to compensate for a color registration error caused by a change in light detection timing by a synchronous signal sensor as a result of an increase or decrease in a light beam width.

22. The image forming apparatus according to claim 12, wherein, when an intensity of light output by the light source is changed from a first light output value to a second light output value, the updated correction value is used to compensate for a color registration error caused by a change in light detection timing by a synchronous signal sensor as a result of an increase or decrease in a light beam width.

23. The color registration error correction apparatus according to claim 18, wherein, when an intensity of light output by a respective one of the light sources is changed from a first light output value to a second light output value, the controller generates data which is used to compensate for a color registration error caused by a change in light detection timing by a respective one of the synchronous signal sensors as a result of an increase or decrease in a light beam width.

* * * * *